United States Patent [19]

Bero

[11] 3,939,620

[45] Feb. 24, 1976

[54] EXTRUDED PLASTIC PANEL-HOLDING STRIP HAVING INTEGRAL FLEXIBLE HINGE

[75] Inventor: Robert D. Bero, Huntington Beach, Calif.

[73] Assignee: Plaskolite, Inc., Columbus, Ohio

[22] Filed: Nov. 11, 1974

[21] Appl. No.: 522,598

[52] U.S. Cl. ..... 52/716; 52/476; 52/494

[51] Int. Cl.[2] ..... E04C 2/38

[58] Field of Search ..... 52/716, 400, 627, 97, 202, 52/624, 455, 290, 203, 588, 476, 494; 160/395; 49/485

[56] References Cited

UNITED STATES PATENTS

| | | | |
|---|---|---|---|
| 1,777,435 | 10/1930 | Hogelund | 52/203 |
| 2,111,343 | 3/1938 | Walz | 52/203 |
| 3,220,469 | 11/1965 | Oehmig | 160/395 |
| 3,360,893 | 1/1968 | Wattelez | 52/400 |
| 3,363,390 | 1/1968 | Crane et al. | 52/716 |
| 3,455,080 | 7/1969 | Meadows | 52/716 |
| 3,715,847 | 2/1973 | Strauss | 52/627 |
| 3,729,045 | 4/1973 | MacDonald | 52/476 |

*Primary Examiner*—Ernest R. Purser
*Assistant Examiner*—Robert Farber
*Attorney, Agent, or Firm*—William S. Rambo

[57] ABSTRACT

A panel-holding strip or sash of extruded plastic composition which includes a pair of opposed channel-forming webs connected by an integral longitudinally coextensive, flexible bight or hinge web; the channel-forming webs being relatively movable in the manner of a book cover between a first open position in which the webs are disposed in angular relation to admit the edge portion of a panel or pane therebetween and a second, closed position in which the webs are frictionally interlocked in channel-forming configuration to hold the edge portion of a panel or pane therebetween; each of the channel-forming webs being formed on their opposing inner surfaces with a first set of relatively engageable and interlocking ribs to frictionally and releasably hold the webs in their closed, channel-defining position and a second set of relatively flexible ribs arranged to frictionally grip and seal the edge portion of a panel or pane positioned between the channel-forming webs of the strip or sash.

5 Claims, 8 Drawing Figures

EXTRUDED PLASTIC PANEL-HOLDING STRIP HAVING INTEGRAL FLEXIBLE HINGE

BACKGROUND OF THE INVENTION

The present invention relates generally to panel-holding or framing strips, and more particularly to extruded plastic channel-forming strips of the type used as storm sash, picture frames, glazing strips, and similar panel-edging strips.

The prior art contains numerous different forms and constructions of metal and plastic channels, panel-edging or framing strips and window sash, both molded and extruded. Typical examples of these prior art panel-framing and/or glazing strips are shown and described in the previously issued U.S. Pats. Nos. 3,363,390 to Crane et al; 3,379,237 to Worthington; 3,455,080 to Meadows and 3,729,045 to MacDonald, which patents are believed to represent the closest known art relative to this invention. However, while the panel-framing and screen and window sash strips shown in the aforementioned prior art patents are satisfactory for their intended end uses, they have relatively limited usage and lack certain functional and constructional features which are embodied in the panel-holding strip of this invention.

SUMMARY AND OBJECTS OF THE INVENTION

The present invention provides an extruded, one-piece, plastic panel-holding strip of generally channel-shaped cross-section which features a flexible hinge web or bight connecting the opposed side walls or webs of the channel for hinging movement between open and closed positions with respect to an outer edge of a panel to be supported by the strip, and wherein opposed sets of relatively engageable ribs are formed on the inner surfaces of the channel-forming side walls of the strip and arranged to provide an interfitting, snap-type locking arrangement between the hingedly connected channel-forming webs.

The primary object of this invention is to provide a comparatively inexpensive extruded plastic channel strip which lends itself particularly for use as a supporting border frame or sash for an interiorly mounted storm window pane, and which is so constructed as to permit the channel strip to be adhesively applied to an interior window of a home or other building, and to be hingedly opened to permit the storm window pane or light to be removed from the strip and the window frame for cleaning or storage.

Another object is to provide a panel-holding strip or border frame member which comprises a single piece, dual durometer, extruded plastic channel having substantially rigid side webs connected by a flexible hinge bight which permits the side webs to be hinged or pivoted so as to open or close the channel, and wherein the inner surfaces of the side webs are formed with integral, snap-locking ribs which may be relatively engaged to hold the side webs of the channel in closed position around the edge of a panel or window pane.

A further object is to provide an extruded plastic framing strip having opposite, hingedly connected side webs formed with sets of longitudinally coextensive locking ribs which permit the strip to be either folded on itself and snap-locked in single channel-forming configuration, or interlocked with one or more additional, identically constructed strips to form a plurality of parallel or angularly related panel-holding channels.

These and other objects and advantages of the invention will become more readily apparent from the following description and the accompanying drawings.

BRIEF DESCRIPTION OF DRAWINGS

FIG. 2 is a fragmentary horizontal sectional view taken through the window frame and the interior draft-preventing window along a plane indicated by the line 2—2 of FIG. 1;

FIG. 6 is a horizontal sectional view showing six of the present panel-holding strips interconnected to form an apex frame for six angularly disposed panels.

DETAILED DESCRIPTION OF PREFERRED EMBODIMENTS

Figure 1:
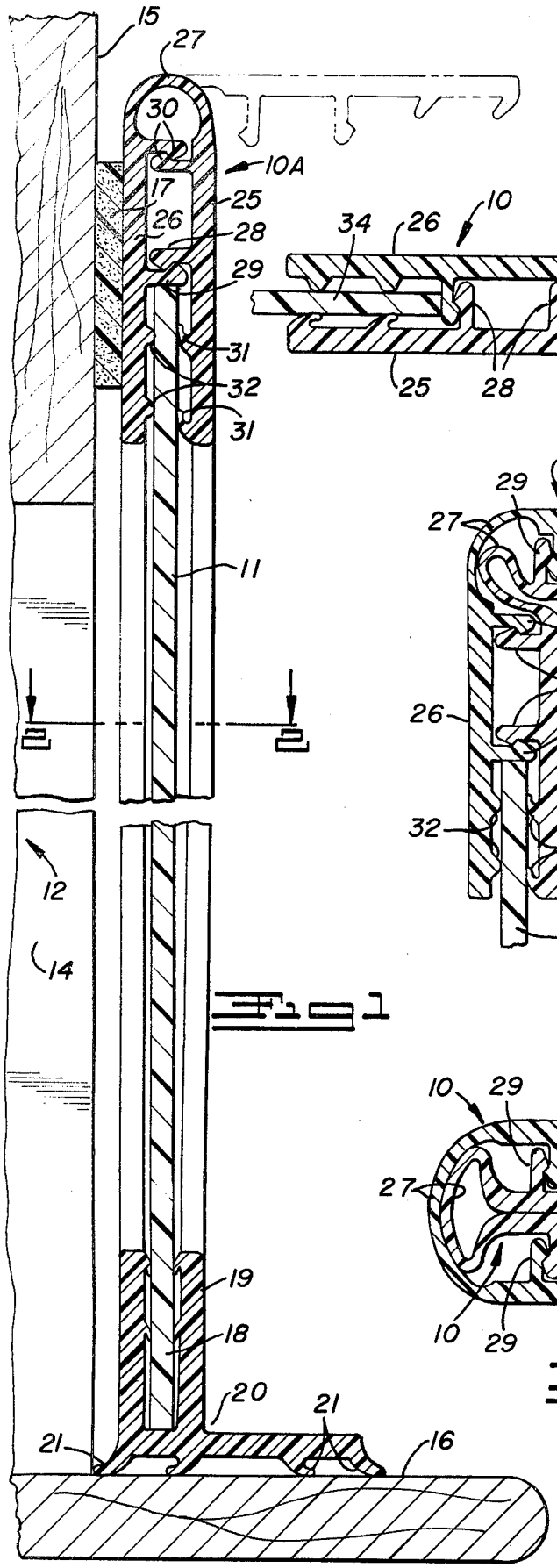
FIG. 1 is a fragmented vertical sectional view taken through a window frame equipped with an interior storm or draft-preventing window which comprises panel-holding strips according to this invention.

FIGS. 1 and 2 illustrate the present extruded plastic panel-holding strips 10*a*, 10*b* and 10*c* used as a border frame or sash for an inside or interiorly positioned storm or draft-preventing panel, pane, or light 11. In FIGS. 1 and 2, reference numeral 12 designates a conventional rectangular window opening defined by a pair of upright side frame members 13 and 14, a horizontal, upper headpiece 15, and a horizontal interior sill 16. Each of the sash strips 10*a*, 10*b* and 10*c* are cut to desired lengths and are adhesively secured by a longitudinally coextensive, pressure sensitive adhesive strip 17 to the inside or interior surfaces of the headpiece 14 and side members 13 and 14 of the conventional wood, metal, or plastic window frame.

Advantageously, the strips 10*a*, 10*b* and 10*c* may be first applied to the upper and opposite side edges of the storm pane 11 before they are pressed into adhesive contact with the interior surfaces of the headpiece 15 and side members 13 and 14 of the window frame. The lower edge portion 18 of the pane 11 is frictionally fitted into the channel portion 19 of a conventional extruded plastic foot strip 20 which extends transversely across the window opening 12 and which is formed with a plurality of integral, flexible weather sealing ribs or webs 21 which are pressed against the upper surface of the window sill 16. In buildings having flush window openings with no interior sill, the foot strip 20 is replaced by one of the present panel holding strips of a length corresponding to the length of the strip 10*a*, and which is adhesively secured to the window frame or wall immediately below the window opening.

In the positions shown in FIGS. 1 and 2, the pane or light 11 is effectively supported and weather sealed on all four sides of the window opening 12 by the present panel-holding strips 10*a*, 10*b* and 10*c* and the foot strip 20, and thus provides an efficient interiorly mounted storm window or auxiliary thermal draft shield which is in addition to the regular window, not shown, which occupies the window opening 12. While the panel-holding strips 10*a*, 10*b* and 10*c* may be detached from the adjacent surfaces of the window frame by prying or peeling the adhesive strips 17 therefrom, this is usually unnecessary since the pane or light 11 and the foot strip 20 may be easily removed from the window opening simply by opening the strips 10*a*, 10*b* and 10*c*, as indicated by broken lines in FIG. 1, and lifting the pane 11 and its foot strip 20 free of the strips 10*a*, 10*b* and 10*c* and the window opening. Thus, the auxiliary panes or lights 11 may be readily removed from the window frame and stored during warm weather and may be easily replaced in the strips 10*a*, 10*b* and 10*c* when needed.

Figure 7:
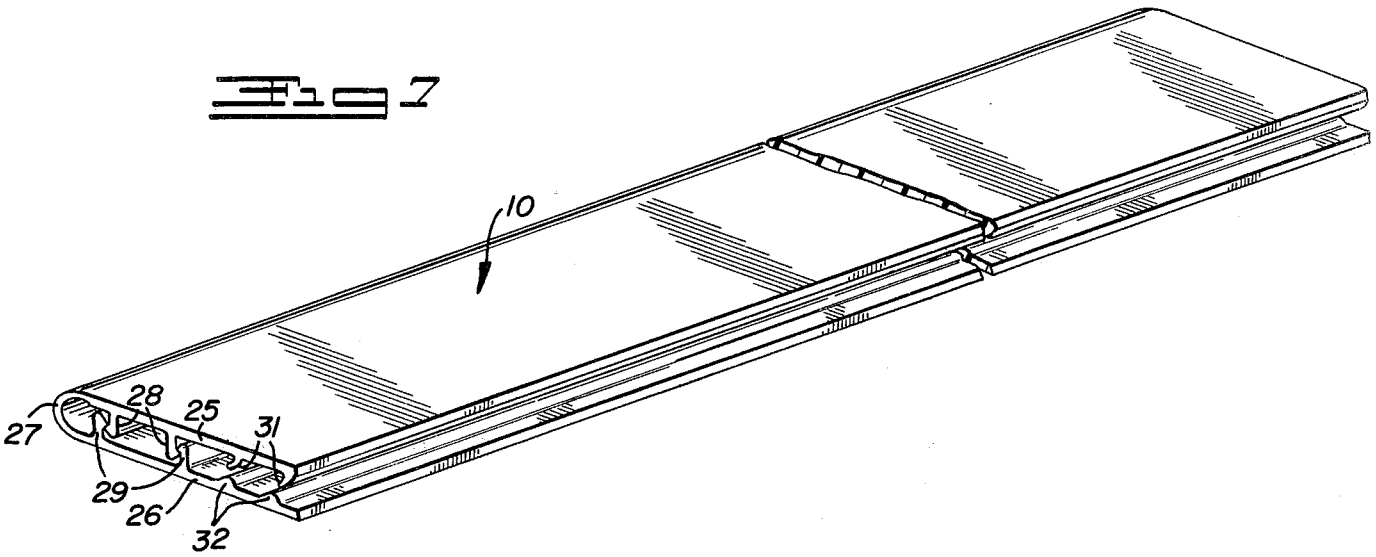
FIG. 7 is a broken perspective view of the panel-holding strip in its closed channel-forming position.
Figure 8:
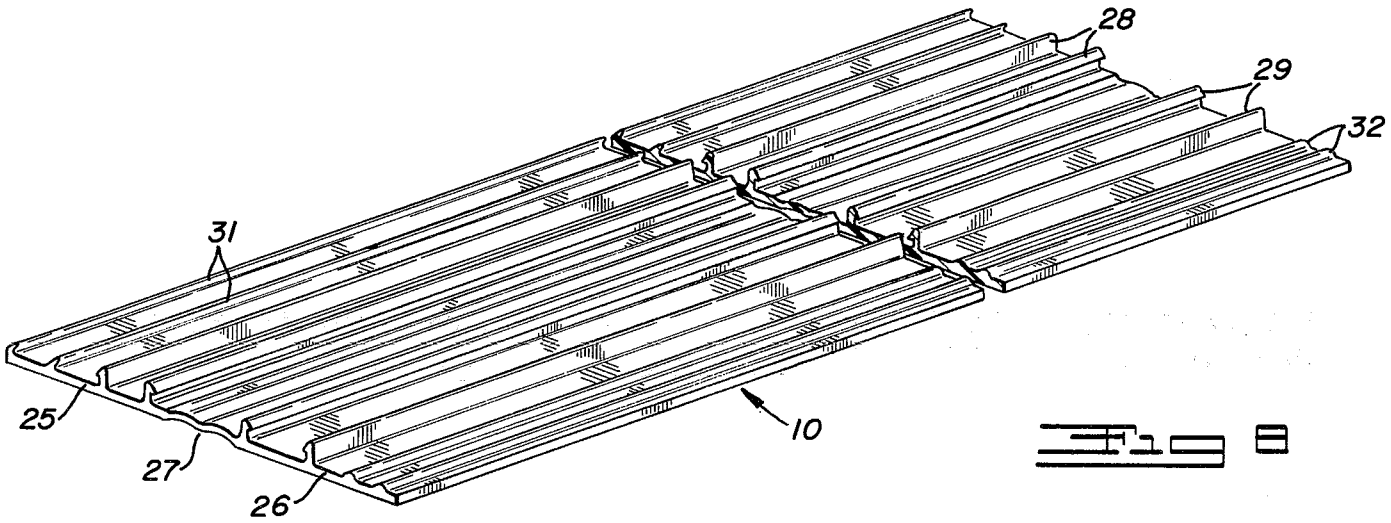
FIG. 8 is a similar view of the panel-holding strip in a flat, open position.

With particular reference to FIGS. 7 and 8 of the drawings, it will be seen that the present panel-holding strip 10 takes the form of an elongated rectangular, one-piece body of synthetic resin (plastic) composition. Preferably, the strips are extruded from a dual durometer plastic, such a polyvinyl chloride, to provide a pair of opposed, rigid, channel-forming side walls or webs 25 and 26 which are joined along one longitudinal edge thereof by an integral, longitudinally coextensive, flexible hinge web 27. The hinge web 27 connects the opposite side walls 25 and 26 of the strip for hinging or pivotal swinging movement between a substantially flat, open position, as illustrated in FIG. 8, and a closed, channel-defining position as illustrated in FIGS. 1, 2, and 7. In this respect, the present panel-holding strip resembles the outer cover of a hardback book.

Each of the side walls 25 and 26 of the strip are formed adjacent the hinge web 27 and on their inner surfaces with sets or pairs of parallel, longitudinally coextensive locking ribs 28 and 29 respectively. The ribs 28 are spaced slightly closer apart than are the ribs 29, and each of the ribs 28 and 29 are formed along their outer edges with shouldered or barbed heads or beads 30. Thus, when the side walls 25 and 26 of the strip are folded or swung to a closed, channel-defining position (FIGS. 1, 2, and 7) the set of ribs 28 move between the set of ribs 29 and the barbed beads 30 of the ribs provide a snap-type interlock for releasably holding the opposite side walls 25 and 26 in relatively closely spaced apart, channel-forming relation. The side walls 25 and 26 of the strip are also formed on their inner surfaces, adjacent their free longitudinal edges, with sets or pairs of inwardly projecting, longitudinally coextensive and flexible panel-sealing and gripping ribs 31 and 32 respectively. The ribs 31 project obliquely inwardly of the channel formed between the side walls 25 and 26 of the strip, while the opposite ribs 32 project generally perpendicularly into the channel to provide a pair of rounded, cushion surfaces for the edge of the panel or pane 11 occupying the channel. Thus, the ribs 31 are arranged to be flexed angularly inwardly of the channel defined between the side walls 25 and 26 when brought into contact with the marginal edge of the panel or pane 11 and tenaciously resist outward displacement or removal of the pane 11 from the channel of the strip.

Uniquely, the locking ribs 28 and 29 serve not only to frictionally snap lock a single strip 10 in its folded, channel-forming configuration, but also provide a snap-locking means for releasably connecting two or more of such strips in multiple channel-forming order. FIGS. 3–6 illustrate the versatility of the present panel-holding strips in providing various different configurations or types of multiple channel, panel-holding edging members.

Figure 3:
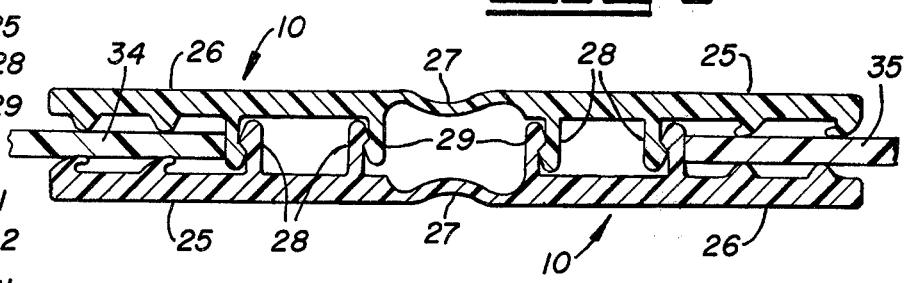
FIGS. 3, 4, and 5 are detailed horizontal sectional views showing two of the present panel-holding strips interconnected to form a mullion and/or a double panel-holding frame.

FIG. 3 illustrates two of the strips 10 interlocked in relatively flat, parallel relationship by the ribs 28 and 29, so as to provide a mullion or double channel frame between a pair of coplanar panels or panes 34 and 35.

Figure 4:
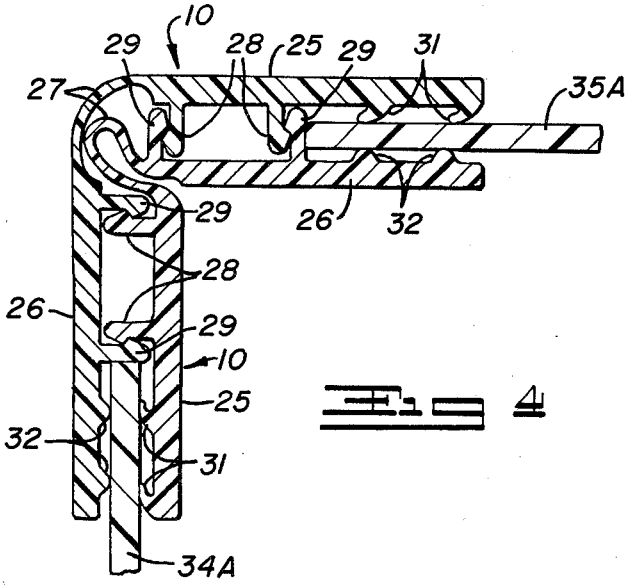

FIG. 4 shows the same two strips 10 interconnected as in FIG. 3, but folded along their hinge webs 27 to form a right angular hinge-type corner strip between two perpendicularly related panels or panes 34*a* and 35*a*.

Figure 5:
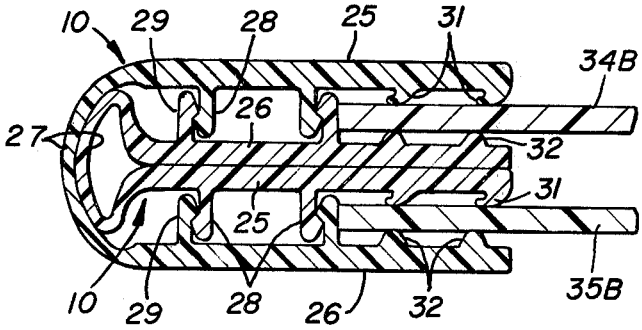
Figures 4, 5:
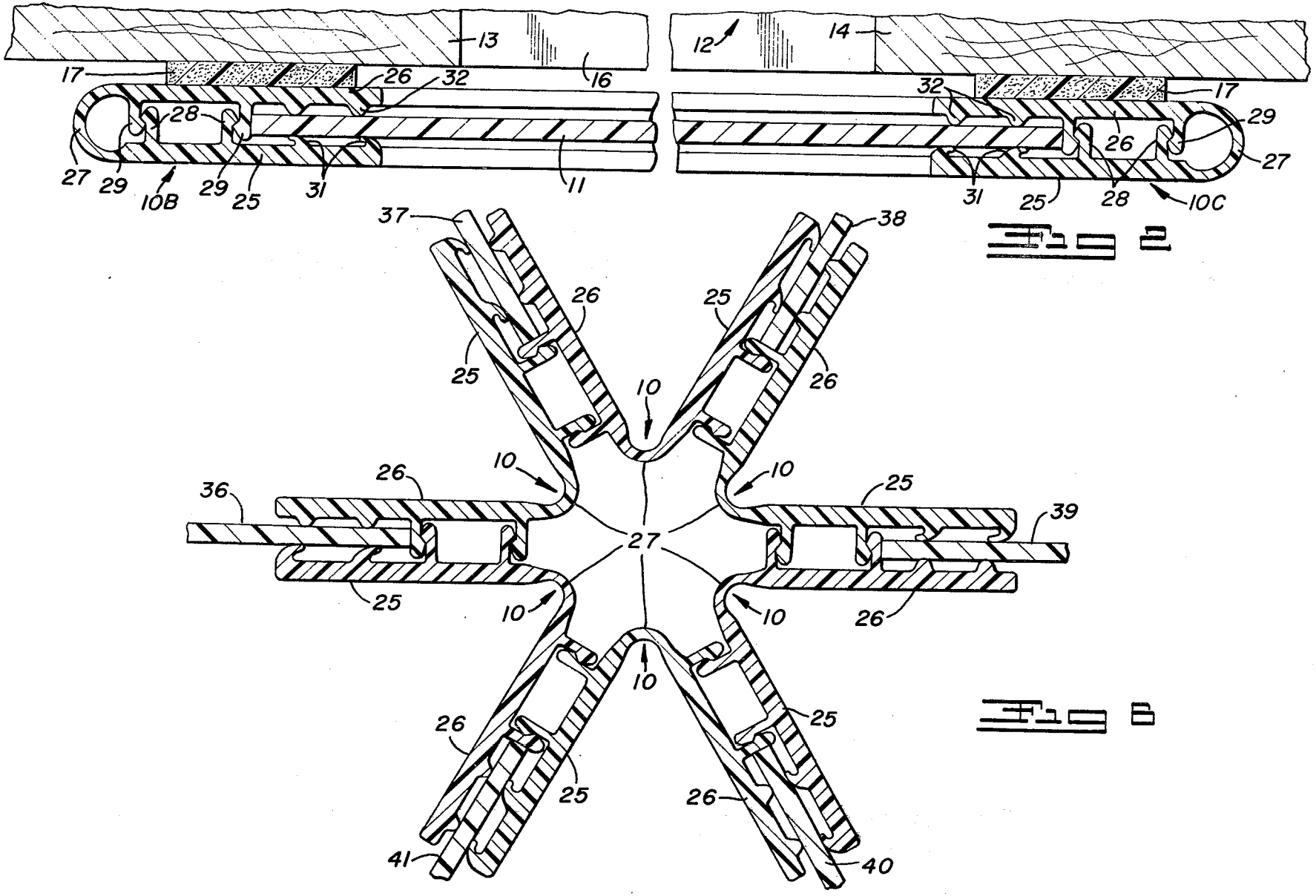

FIG. 5 illustrates the two interconnected strips 10 of FIGS. 3 and 4 folded along their flexible hinge webs 27 to form a double channel arrangement to receive and hold two, relatively spaced apart, parallel panels or sheets 34*b* and 35*b*. The arrangement of the strips, as shown in FIG. 5, is particularly useful in providing a dual panel-holding sash, such as might be used for a double pane storm window, or a combination storm pane and screen window.

FIG. 6 shows an arrangement in which six of the panel-holding strips 10 are interlocked to receive and support six angularly related panels 36, 37, 38, 39, 40 and 41, such as might be used to form the vertically arranged walls of a multicompartment display booth or carol.

It should be understood that the present panel-holding strip is not restricted in its use to a sash strip for holding or framing window panes, but may be used generally as a frame member to receive and hold a marginal edge portion of numerous different types of rigid, semi-rigid, or flexible panels or sheets, such as: loose leaf paper, paper board, metal wire screens, photographs, posters, bulletin boards, mirrors, etc. In this regard, the relatively close spacing between the panel-gripping ribs 31 and 32, coupled with their flexibility, readily adapts the strips to receive and hold panels or sheets of varying thickness.

It will, therefore, be apparent that the present invention provides a hightly versatile and efficient, foldable panel-holding strip which is characterized by its ability to be folded on itself and releasably locked to provide a single channel, border frame strip for a single panel or sheet, or interlocked with one or more identical strips to form plural channels to receive and hold a plurality of panels or sheets disposed in various angular relation to one another.

While a preferred embodiment of the invention has been shown and described in detail, it will be understood that various modifications in details of construction and design are possible without departing from the spirit of the invention or the scope of the following claims.

I claim:

1. A panel-holding strip comprising an elongated, one-piece body of dual durometer, extruded plastic composition, said body including a pair of opposed, longitudinally coextensive, generally flat rectangular, rigid, channel-forming webs connected along adjacent longitudinal edges thereof by an intergral, flexible hinge web, said channel-forming webs being movable between an angularly related open position and a closed, channel-defining position in which said channel-forming webs are disposed in relatively closely spaced apart parallel relation, and each of said channel-forming webs having an inner surface which includes sets of longitudinally coextensive, transversely spaced apart, parallel, inwardly projecting ribs, one set of the ribs on one of said channel-forming webs being arranged to frictionally interlock with a set of ribs on the other of said channel-forming webs to releaseably hold said channel-forming webs in their closed, channel-defining position, and other sets of the ribs on each of said channel-forming webs being flexible and being arranged in spaced opposition to one another to frictionally grip and seal the edge of a panel inserted between said channel-forming webs when they occupy their closed, channel-defining position.

2. A panel-holding strip according to claim 1 which further includes an adhesive strip carried on the outer surface of one of the channel-forming webs of said body for adhesively securing said panel-holding strip to a supporting surface.

3. A panel-holding strip according to claim 1, wherein the frictionally interlocking ribs of one of said channel-forming webs are spaced transversely farther apart than the complemental interlocking ribs of the other of said channel-forming webs.

4. A panel-holding strip according to claim 1, in combination with a transparent plastic sheet having an edge portion thereof held between the flexible ribs of said channel-forming webs.

5. A panel-holding strip according to claim 3, wherein the frictionally interlocking ribs of each of said channel-forming webs terminate in hook-shaped beads.

* * * * *